US006193403B1

(12) United States Patent
Nystrom

(10) Patent No.: US 6,193,403 B1
(45) Date of Patent: Feb. 27, 2001

(54) BUCKET MIXER ATTACHMENT FOR SKID STEER VEHICLE

(76) Inventor: Leroy C. Nystrom, 21777 Olson St., Elk River, MN (US) 55330

( * ) Notice: Subject to any disclaimer, the term of this patent is extended or adjusted under 35 U.S.C. 154(b) by 0 days.

(21) Appl. No.: 09/273,896

(22) Filed: Mar. 22, 1999

Related U.S. Application Data

(60) Provisional application No. 60/078,959, filed on Mar. 23, 1998.

(51) Int. Cl.[7] ..... B01F 7/08

(52) U.S. Cl. ..... 366/26; 366/50; 366/66; 366/186; 366/193; 366/196; 366/299; 366/319; 366/324; 366/603; 366/606

(58) Field of Search ..... 366/26, 45, 46, 366/50, 64, 66, 185, 186, 193–196, 297–301, 318–324, 345, 603, 606

(56) References Cited

U.S. PATENT DOCUMENTS

| | | | | |
|---|---|---|---|---|
| 1,727,992 | | 9/1929 | King . | |
| 2,815,195 | | 12/1957 | Bolt . | |
| 2,947,524 | | 8/1960 | Bridges . | |
| 3,090,605 | * | 5/1963 | Copeland et al. . | |
| 3,126,197 | | 3/1964 | Maurer et al. . | |
| 3,188,059 | | 6/1965 | Strong . | |
| 3,421,740 | * | 1/1969 | Behrens . | |
| 3,598,266 | | 8/1971 | Fisher . | |
| 3,790,138 | * | 2/1974 | Neier . | |
| 3,797,807 | * | 3/1974 | Behrens . | |
| 3,995,836 | | 12/1976 | Carter et al. . | |
| 4,068,771 | | 1/1978 | Zimmerman . | |
| 4,268,174 | | 5/1981 | Falardeau . | |
| 4,373,845 | | 2/1983 | Henke . | |
| 4,447,158 | * | 5/1984 | Simon | 366/297 |
| 4,448,536 | | 5/1984 | Strong . | |
| 4,462,693 | | 7/1984 | Buschbom et al. . | |
| 4,597,672 | * | 7/1986 | Neier et al. | 366/603 |
| 4,864,748 | | 9/1989 | Boyer . | |
| 4,938,650 | | 7/1990 | Jenkins et al. . | |
| 4,951,883 | * | 8/1990 | Loppoli et al. | 241/260.1 |
| 5,148,999 | * | 9/1992 | Curfman et al. | 366/603 |
| 5,299,865 | * | 4/1994 | Presnell | 366/320 |
| 5,379,940 | * | 1/1995 | Knight et al. | 366/297 |
| 5,385,403 | * | 1/1995 | Knight et al. | 366/297 |
| 5,401,402 | * | 3/1995 | Christy et al. | 366/320 |
| 5,556,196 | | 9/1996 | Lin . | |
| 5,592,760 | | 1/1997 | Kohout . | |
| 5,601,239 | * | 2/1997 | Smith et al. | 241/260.1 |
| 5,630,944 | * | 5/1997 | Terblanche | 366/298 |
| 5,782,559 | * | 7/1998 | Neier et al. | 366/297 |
| 6,000,649 | * | 12/1999 | Loppoli | 241/260.1 |
| 6,007,008 | * | 12/1999 | Neier | 241/260.1 |

* cited by examiner

*Primary Examiner*—Charles E. Cooley
(74) *Attorney, Agent, or Firm*—Burd, Bartz & Gutenkauf

(57) ABSTRACT

A mixer for particulate materials, such as soil, dirt, sand, concrete, lime, fertilizers, aggregate, and water, hitched to a skid steer motor vehicle has a bucket for accommodating the particulate materials. A pair of augers having opposite spiral flights located within the bucket are driven by a hydraulic fluid operated motor to mix the particulate materials. The operator of the vehicle controls the hydraulic motor to reverse the rotational direction of the augers to control the mixing of the particulate materials. A door mounted on the side wall of the bucket is movable with a hydraulic cylinder to an open position to allow the particulate materials to be discharged from the bucket.

39 Claims, 5 Drawing Sheets

BUCKET MIXER ATTACHMENT FOR SKID STEER VEHICLE

This application claims benefit to Provisional Application 60/078,959 filed Mar. 23, 1998.

FIELD OF THE INVENTION

The invention is in the field of attachments for motor vehicles and tractors for mixing and transporting particulate materials. The attachment is a bucket hitchable to a skid steer motor vehicle. Augers mounted on the bucket are driven with a hydraulic motor to mix particulate materials in the bucket.

BACKGROUND OF THE INVENTION

Front end tractor loaders and skid steer vehicles use bucket attachments for digging and loading materials and transporting the materials to a selected location. The vehicles have lift and tilt structures that control movements of the buckets and allow the buckets to be tilted forwardly to dump materials out of the bucket. C. M. Fisher in U.S. Pat. No. 3,598,266 and J. E. Zimmerman in U.S. Pat. No. 4,068,711 disclose buckets mounted on the lift arms of tractors for accommodating concrete and pouring concrete into a mold or a small area. The concrete in the buckets is not mixed in the buckets. Ready mix concrete or concrete from a concrete mixer must be placed in the buckets which are only used to transport and dump the concrete in selected locations. Concrete mixers have been developed to be mounted on tractors which transport mixed concrete to the work site. R. M. Bolt in U.S. Pat. No. 2,815,195 and F. Falardeau in U.S. Pat. No. 4,268,174 disclose concrete mixers having drum-type housings or buckets and concrete mixing blades and augers rotatably mounted on single shafts which are rotatably mounted on the end walls of the buckets. Two or more laterally spaced augers are not used to mix concrete in the bucket.

SUMMARY OF THE INVENTION

The invention is an apparatus for mixing particulate materials and moving the mixed materials to a selected discharge location. The apparatus accommodates different types of materials, including but not limited to soil, dirt, sand, organic materials, aggregates, concrete, water, lime, fertilizers, and animal feeds. The apparatus has a bucket hitched to a skid steer vehicle. A pair of transverse augers rotatably mounted on the bucket have opposite spiral flights that reverse the movement of the particulate materials to facilitate efficient mixing of the materials. A hydraulic fluid operated motor drives a sprocket and chain power transmission to concurrently rotate the augers which mix the materials in the bucket. A side wall of the bucket adjacent an end of an auger has an opening which allows the auger to discharge the mixed materials from the bucket. A door movably mounted on the side wall of the bucket selectively opens and closes the opening to control the discharge of material from the bucket. A hydraulic cylinder connected to the door operates to open and close the door.

DESCRIPTION OF PREFERRED EMBODIMENT OF THE INVENTION

Figure 1:
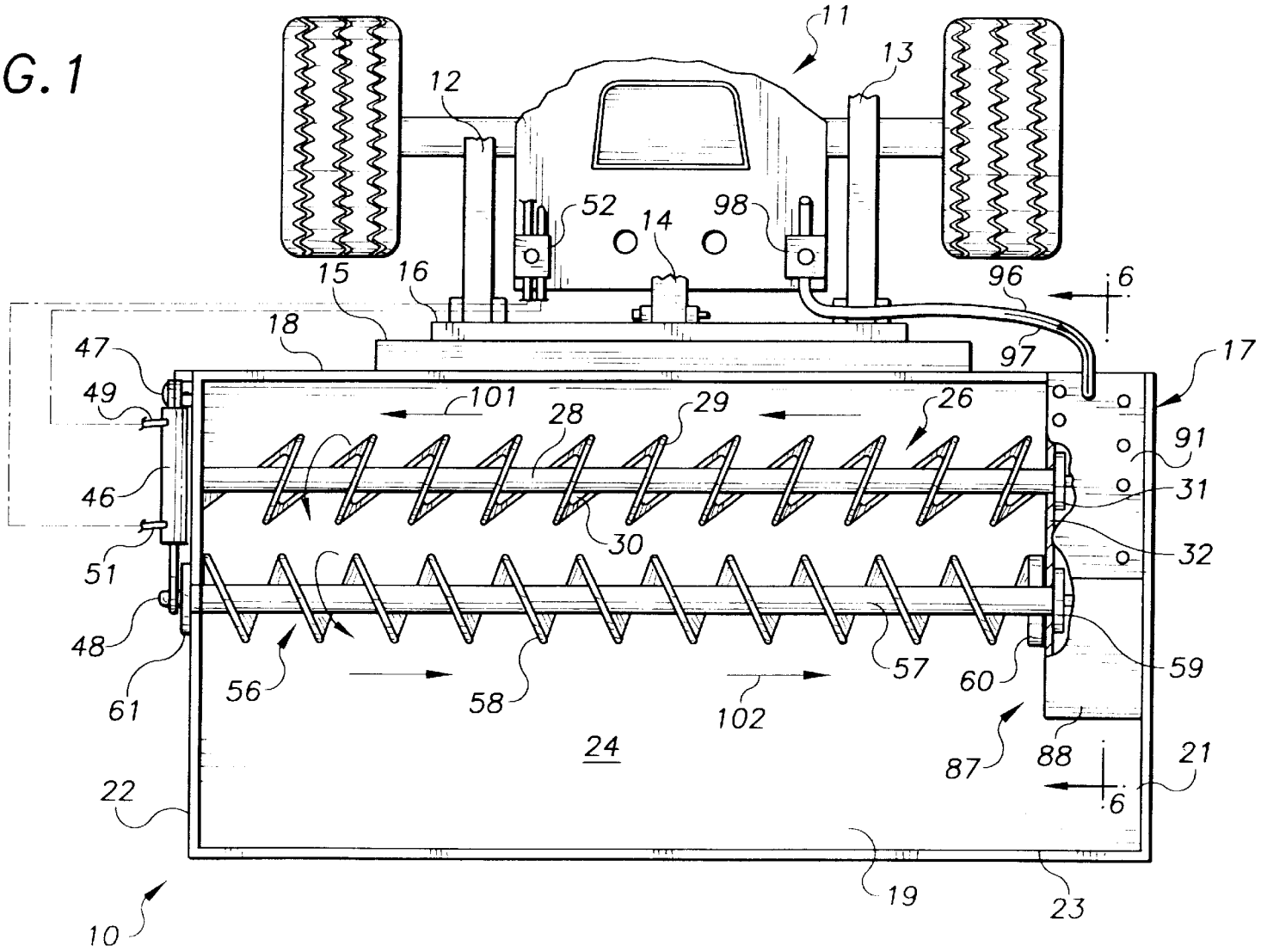
FIG. 1 is a top plan view of a material mixer of the invention connected to a skid steer motor vehicle.
Figure 2:
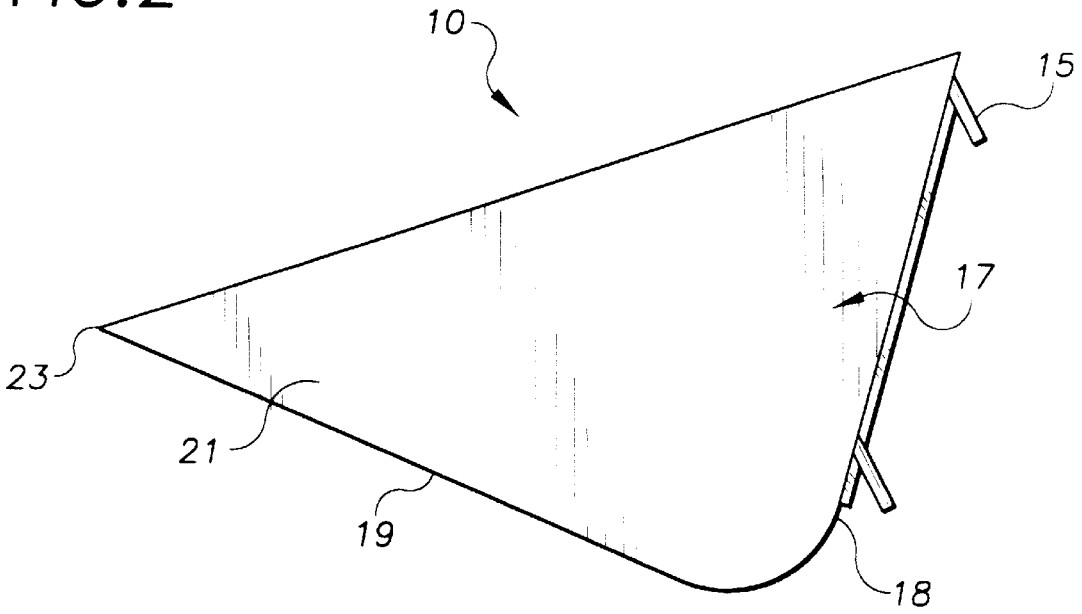
FIG. 2 is a side elevational view of the right side of FIG. 1.

The material mixer of the invention, indicated generally at 10 in FIG. 1, is connected to a skid steer motor vehicle 11. Mixer 10 is used to mix soils, sands, aggregates, concrete and water, and like particulate materials and discharge or dump the mixed materials to selected locations. Vehicle 11 is used to supply hydraulic fluid under pressure to operate the mixer and transport the mixer including the materials to a material discharge location.

Vehicle 11 is a conventional skid steer tractor having lift arms 12 and 13 and a tilt control cylinder 14 connected to a hitch 16. Other types of vehicles, such as track tractors can be used to carry and operate mixer 10. Hitch 16 connects mixer 10 to vehicle 11 and allows the operator to utilize lift arms 12 and 13 and tilt control cylinder 14 to raise, lower and tilt mixer 10. Hitch 16 is coupled to a hitch connector assembly or mounting bracket 15 attached to mixer 10.

Mixer 10 comprises a bucket 17 having a back wall 18, a bottom wall 19 and generally triangular side walls 21 and 22 secured to the back and bottom walls 18 and 19. Connector assembly 15 secured to back wall 18 releasably accommodates hitch 16 to mount mixer 10 in front of vehicle 11. An example of a mounting bracket for the hitch of a skid steer vehicle is disclosed by D. A. Kohout in U.S. Pat. No. 5,592,760. Bottom wall 19 has a transverse front edge 23 extended between the forward ends of side walls 21 and 22. Walls 18, 19, 21 and 22 provide a chamber 24 for accommodating particulate materials.

Figure 4:
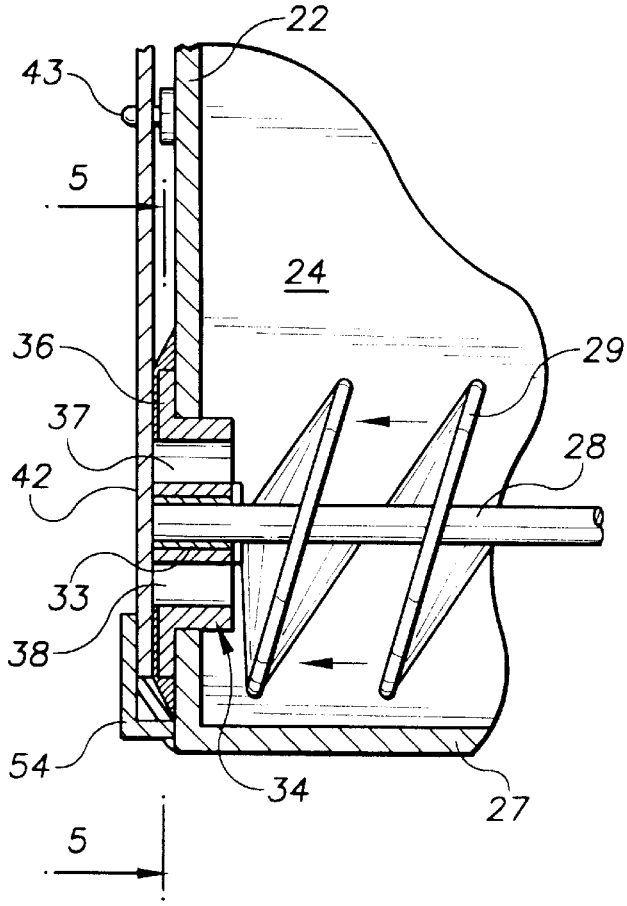
FIG. 4 is an enlarged sectional view taken along the line 4—4 of FIG. 3.
Figure 5:
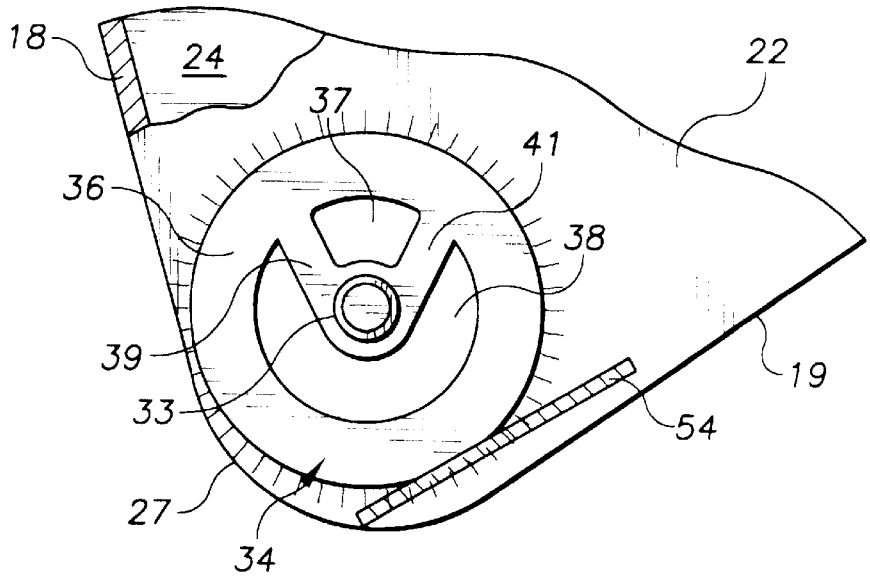
FIG. 5 is a sectional view taken along the line 5—5 of FIG. 4.

A first auger 26 extended transversely adjacent a rounded lower corner wall 27 of bucket 17 has a shaft 28 and a spiral flight 29 secured to shaft 28. Flight 29 has a plurality of circumferentially spaced openings or holes 30 in the middle section of flight 29. The entire length of flight 29 can have circumferentially spaced holes. The materials flow through holes 30 during mixing to allow some reverse flow of materials adjacent auger 26 and facilitate mixing of the materials. A first bearing 31 rotatably mounts one end of shaft 28 on a housing wall 32. A second bearing 33, shown in FIGS. 4 and 5, rotatably mounts the outer end of shaft 28 on a hub 34 secured to side wall 22. Hub 34 has a circular flange 36 secured to wall 22 and openings 37 and 38 open to chamber 24 to allow auger 26 to discharge materials from chamber 24 to a location adjacent the side of bucket 17. Supports 39 and 41 extend inwardly from flange 36 to retain bearing 33 in axial alignment with bearing 31. The mixed materials in mixer 10 can be dumped to a selected location by lifting mixer 10 with lift arms 12 and 13 and tilting mixer 10 forwardly by expanding cylinder 14.

Figure 3:
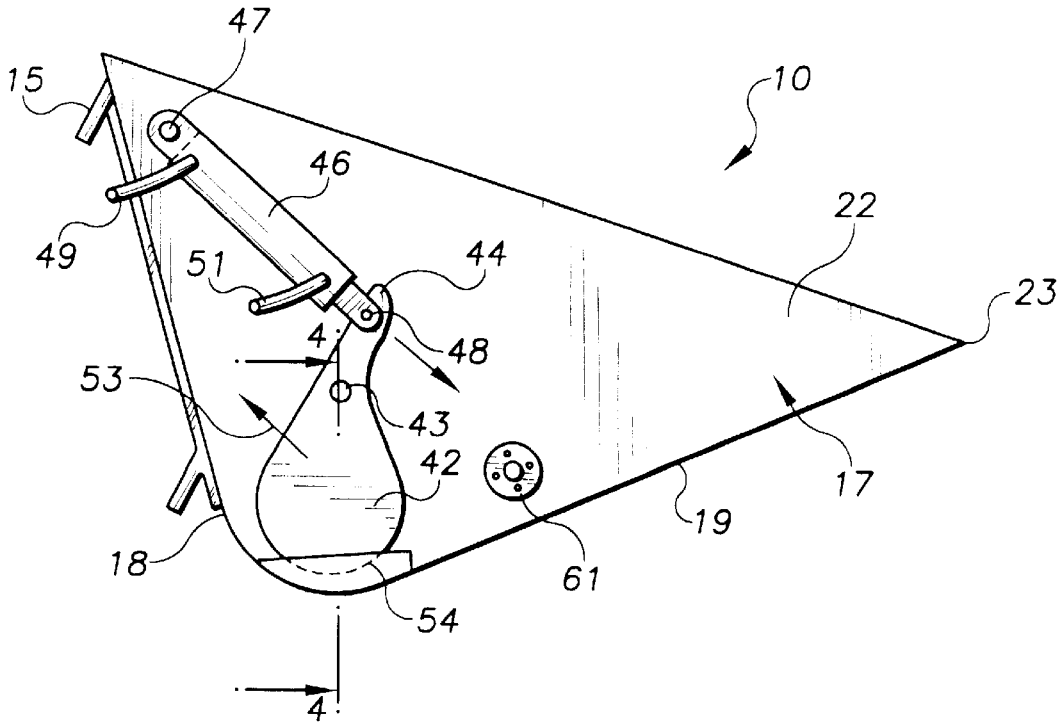
FIG. 3 is a side elevational view of the left side of FIG. 1.

A door 42 pivotally mounted on wall 22 with a pivot member or pin 43 closes openings 37 and 38 to confine the materials to chamber 24. As shown in FIG. 3, door 42 has an upwardly inclined arm 44 above pivot member 43. A double acting hydraulic cylinder 46 is connected with a pivot member 47 to wall 22 and a pivot pin 48 to the outer end of arm 44. Cylinder 46 is connected with fluid carrying hoses to a manually operated control 52 mounted on vehicle 11, as shown in FIG. 1.

Returning to FIG. 3, when cylinder 46 is expanded door 42 is pivoted in the direction of arrow 53 to an open position to allow materials in chamber 24 to be moved through openings 37 and 38 during rotation of auger 26. Door 42 pivots to the closed position when cylinder 46 is contracted. The lower edge of door 42 fits behind a rib 54 secured to wall 22. Rib 54 maintains door 42 adjacent the outside of hub 34 and prevents door 42 from being moved laterally when it is in the closed position.

Figure 8:
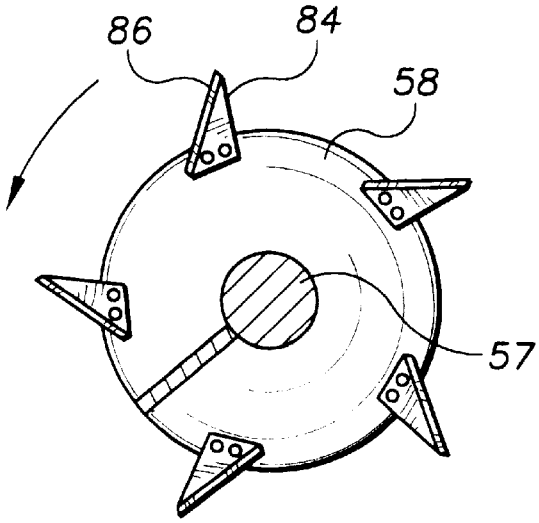
FIG. 8 is a cross sectional view of an auger having knives attached to the flight of the auger.

A second auger 56 extends transversely across bottom wall 19 in front of auger 26. Auger 56 is parallel to and laterally spaced from auger 26. Auger 56 has a transverse shaft 57 and a spiral flight 58 secured to shaft 57. The spiral configuration of flight 58 is opposite the spiral twist or helical configuration of flight 29. Auger 26 has a right hand flight 29 and auger 56 has a left hand flight 58. Each auger 26 and 56 has, for example, a 10 inch diameter flight. Other sizes and pitches of augers can be used to mix materials in bucket 17. As shown in FIG. 8, flight 58 can support outwardly directed knives 84 having outwardly inclined cutting edges 86. Knives 84 cut up bulk materials in chamber 24 during rotation of auger 56.

A first bearing assembly 59 rotatably mounts one end of shaft 57 on housing wall 32. A radial bar or plate member 60 secured to shaft 57 adjacent wall 32 flips and moves materials away from wall 32 toward first auger 26 to prevent packing and build up of material on wall 32.

Figure 6:
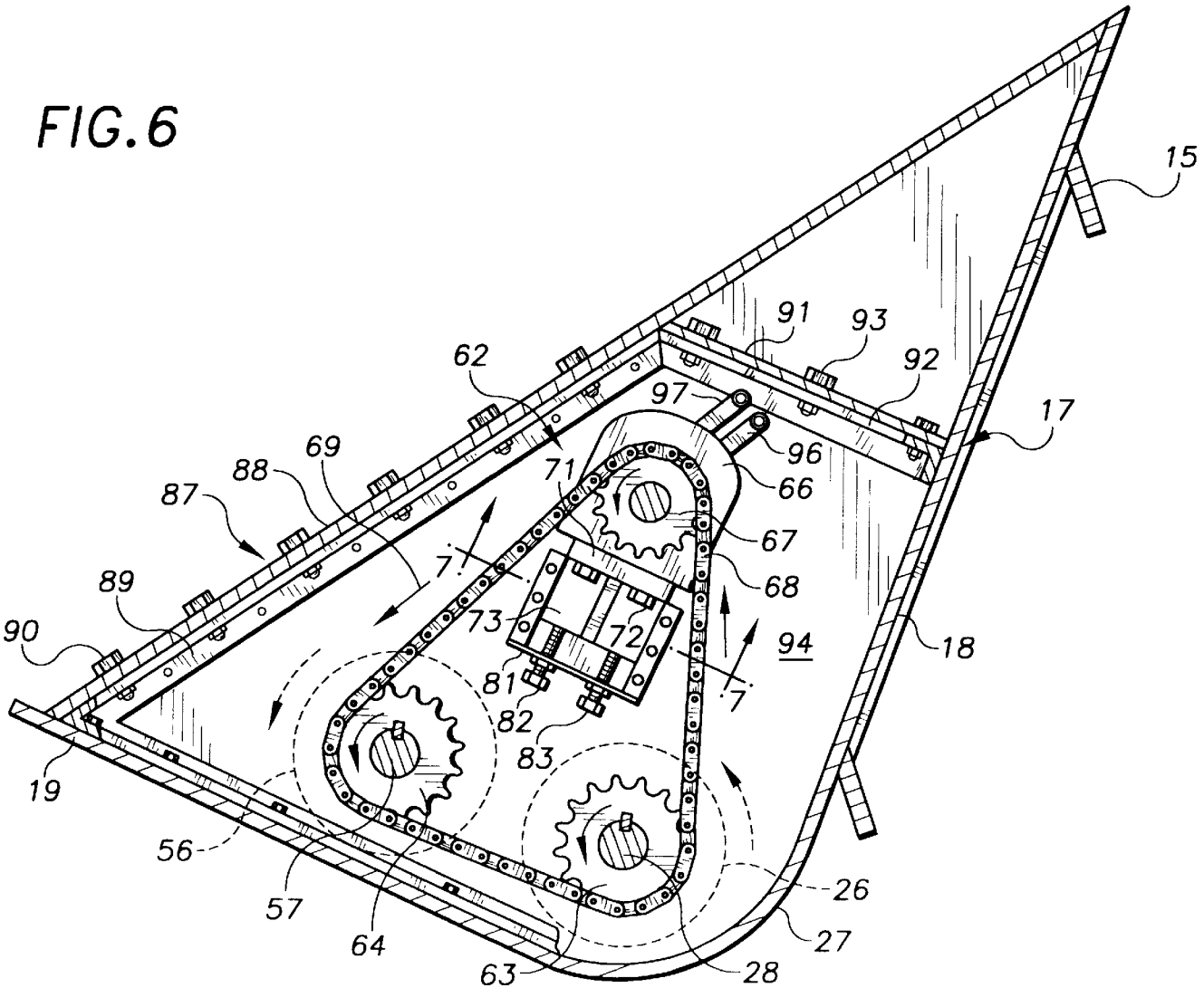
FIG. 6 is an enlarged sectional view taken along the line 6—6 of FIG. 1.
Figure 7:
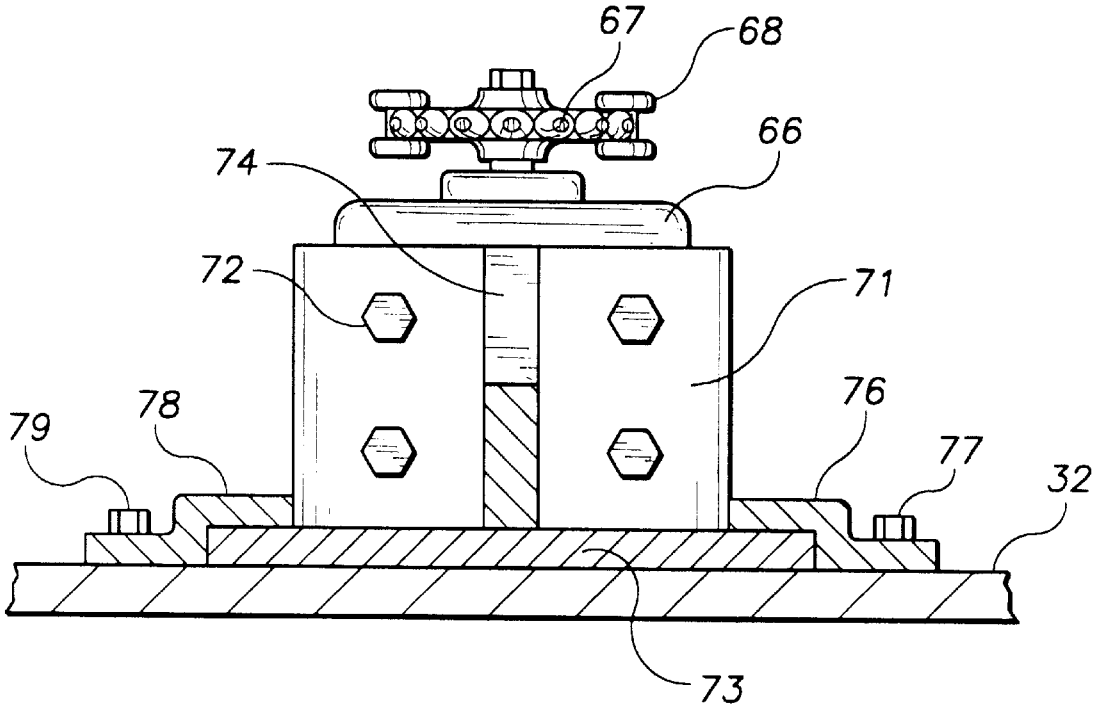
FIG. 7 is an enlarged sectional view taken along the line 7—7 of FIG. 6.

As shown in FIG. 6, a drive mechanism, indicated generally at 62, concurrently rotates augers 26 and 56 to mix material in chamber 24 of bucket 17. Drive mechanism 62 has a sprocket 63 keyed to shaft 28 of auger 26 and a sprocket 64 keyed to shaft 57 of auger 56. Sprockets 63 and 64 have the same diameters and number of teeth whereby augers 26 and 56 concurrently rotate at the same revolutions per minute. A motor 66, such as a hydraulic fluid operated motor, has a drive sprocket 67. Power is transmitted from drive sprocket 67 to sprockets 63 and 64 with an endless link chain 68. Motor 66 drives endless chain 68 in the direction of arrow 69 which rotates augers 26 and 56 in the same direction. An endless belt can be used in lieu of chain 68. The direction of operation of motor 66 can be reversed to change the direction of rotation of augers 26 and 56. Motor 66 is mounted on a support 71 and secured thereto with bolts 72. As shown in FIG. 7, support 71 is attached to a plate 73 with welds and a gusset member 74. Plate 73 is retained in surface engagement with wall 32 with upright guides 76 and 78. Bolts 77 and 79 secure guides 76 and 78 to wall 32. Guides 76 and 78 have lower lips or flanges that extend over opposite upright edges of plate 73 to allow upright movement of plate 73 to adjust the tension of chain 68. As seen in FIG. 6, a plate 81 is secured to the lower ends of guides 76 and 78. A pair of bolts 82 and 83 threaded in holes in plates 81 or nuts secured to plate 81 contact the lower edge of plate 73. Bolts 82 and 83 adjust the location of plate 73 and retain the plate 73 in its adjusted position thereby maintaining the tension of chain 68.

Drive mechanism 62 is enclosed within a housing 87 located adjacent the inside of side wall 21 of the bucket 17. Housing 87 has an upwardly and rearwardly inclined front wall 88 attached to a frame member 89 with bolts 90. Frame members 89 is secured to side wall 32. The top of housing 87 has a flat cover 91 attached to frame member 92 with bolts 93. Cover 91 can be removed from frame member 92 to provide access to chamber 94 accommodating drive mechanism 62.

Motor 66 is supplied with hydraulic fluid under pressure from motor vehicle 11. Hoses 96 and 97 connect motor 66 with a control valve 98 on vehicle 11, shown in FIG. 1. Control valve 98 is manually operated by the vehicle operator to regulate the speed of operation of motor 66 and direction of rotation of drive sprocket 67 thereby control the speed and direction of rotation of auger 26 and 56.

In use particulate materials, such as soil and organic matter, fertilizers, lime, sand, cement, or animal feeds are placed in bucket chamber 24. Bucket 23 can be moved by vehicle 11 to scoop particulate materials into chamber 24. Control valve 98 is operated to allow hydraulic fluid to flow to and from motor 66 to operate motor 66. Drive mechanism 62 transmits power from motor 66 to augers 26 and 56 thereby turning the augers. Augers 26 and 56 move the particulate materials in chamber 24 in opposite directions, as shown by arrows 101 and 102 in FIG. 1. The materials flow through holes 30 in the middle of auger flight 29 to facilitate material mixing and provide relief from materials moved by augers 26 and 56. The directions of movements of the particulate materials in chamber 24 can be reversed by reversing the direction of operation of motor 66 which turns augers 26 and 56 in opposite directions.

The mixed materials in bucket chamber 24 are unloaded by opening door 42 with hydraulic cylinder 46. Auger 26 aligned with openings 37 and 38 is turned to force particulate materials through openings 37 and 38 to a location adjacent the side of bucket 17. When bucket chamber 24 is empty, door 42 is closed by contracting cylinder 46. Control 52 is used by the vehicle operator to regulate the operation of cylinder 46 to open and close door 42. The mixed materials in bucket chamber 24 can be dumped out of the front of the bucket 23 by raising the lift arms 12 and 13 and tilting bucket 23 forward with cylinder 14.

From the foregoing detailed description of the present invention it has been shown how the objects of the invention have been obtained in a preferred manner. However, modifications and equivalents of the disclosed concepts, such as those which readily occur to those skilled in the art, are intended to be included within the scope of this invention. Thus, the scope of this invention is intended to be limited only by the scope of the claims which are, or which may hereafter be, appended hereto.

What is claimed is:

1. In combination, a materials mixing and transport apparatus and a motor vehicle having lift arms for raising and lowering the apparatus, said apparatus having a bucket having a back wall, a bottom wall, a rounded corner wall joined to the back wall and bottom wall and first and second side walls secured to the back, bottom and corner walls providing a chamber for accommodating materials, a housing secured to the first side wall, hitch means secured to the back wall connected to the lift arms to mount the bucket on the lift arms, a first auger located in said chamber adjacent said rounded corner wall, first means rotatably mounting one end of the first auger on the housing, second means rotatably mounting the other end of the first auger on the second side wall, a second auger located in said chamber adjacent said first auger, third means rotatably mounting one end of the second auger on the housing, fourth means rotatably mounting the other end of the second auger on the second side wall, drive means located within the housing operatively connected to the first and second augers to concurrently rotate the first and second augers, and motor means connected to the drive means operable to transmit power to the drive means to rotate the first and second augers thereby mixing the materials in the chamber of the bucket.

2. The combination of claim 1 wherein: the first auger has a first flight and the second auger has a second flight, said first flight having a helical twist opposite the helical twist of the second flight.

3. The combination of claim 1 wherein: the first auger has a helical flight and circumferentially spaced holes in the helical flight to allow materials to flow through the helical flight.

4. The combination of claim 3 wherein: the holes in the helical flight are in the middle portion of the helical flight.

5. The combination of claim 3 wherein: the first auger has a first flight and the second auger has a second flight, said first flight having a helical twist opposite the helical twist of the second flight.

6. The combination of claim 1 wherein: the second auger has a radial member at one end thereof to move material away from the wall adjacent the one end of the second auger.

7. The combination of claim 1 wherein: the second auger has a helical flight, and a plurality of knives mounted on the flight and extended outwardly from the flight to cut said materials.

8. The combination of claim 1 including: mount means located within the housing supporting the motor means within the housing.

9. The combination of claim 1 wherein: the drive means comprises sprockets mounted on the first and second augers and the motor means and an endless power transmitting member trained about said sprockets whereby the motor means concurrently rotates said first and second augers, and mount means located within the housing supporting the motor means on the housing.

10. A materials mixing and transport apparatus for use with a motor vehicle having a hitch comprising: a bucket having a back wall, a bottom wall, a rounded corner wall joined to the back wall and bottom wall and first and second side walls secured to the back, bottom and corner walls providing a chamber for accommodating materials, a housing secured to the first side wall, means secured to the back wall for accommodating the hitch to mount the bucket on the hitch, a first auger located in said chamber adjacent said rounded corner wall, first means rotatably mounting one end of the first auger on the housing, second means rotatably mounting the other end of the first auger on the second side wall, a second auger located in said chamber adjacent said first auger, third means rotatably mounting one end of the second auger on the housing, fourth means rotatably mounting the other end of the second auger on the second side wall, drive means located within the housing operatively connected to the first and second augers to concurrently rotate the first and second auger, motor means connected to the drive means operable to transmit power to the drive means to rotate the first and second augers thereby mixing the materials in the chamber of the bucket, said second side wall has an opening adjacent the other end of the first auger to allow the first auger to move material through said opening to a location adjacent the bucket, door means mounted on the second side wall for selectively opening and closing said opening, and means to move the door means between open and closed positions relative to the opening.

11. The apparatus of claim 10 including: pivot means mounting the door means on the second side wall, said means to move the door means comprising a fluid operated cylinder connected to the door means operable to move the door means between said open and closed positions relative to the opening.

12. The apparatus of claim 11 including: a rib mounted on the second side wall adjacent a lower portion of the opening, said door means having a portion engageable with the rib when the door means is in the closed position to retain the door means in the closed position.

13. A materials mixing and transport apparatus for use with a motor vehicle having a hitch comprising: a bucket having a back wall, a bottom wall, a rounded corner wall joined to the back wall and bottom wall and first and second side walls secured to the back, bottom and corner walls providing a chamber for accommodating materials, a housing secured to the first side wall, means secured to the back wall for accommodating the hitch to mount the bucket on the hitch, a first auger located in said chamber adjacent said rounded corner wall, first means rotatably mounting one end of the first auger on the housing, second means rotatably mounting the other end of the first auger on the second side wall, a second auger located in said chamber adjacent said first auger, third means rotatably mounting one end of the second auger on the housing, fourth means rotatably mounting the other end of the second auger on the second side wall, drive means located within the housing operatively connected to the first and second augers to concurrently rotate the first and second auger, motor means connected to the drive means operable to transmit power to the drive means to rotate the first and second augers thereby mixing the materials in the chamber of the bucket, the second side wall has an opening adjacent the other end of the first auger, a tubular hub mounted on the second side wall extended into the opening, said hub having means to rotatably mount the other end of the first auger, door means mounted on the second side wall for selectively opening and closing said opening, and means to move the door means between said open and closed positions relative to the opening.

14. The apparatus of claim 13 including: pivot means mounting the door means on the second side wall, said means to move the door means comprising a fluid operated cylinder connected to the door means operable to move the door means between open and closed positions relative to the opening.

15. The apparatus of claim 14 including: a rib mounted on the second side wall adjacent a lower portion of the opening, said door means having a portion engageable with the rib when the door means is in the closed position to retain the door means in the closed position.

16. A materials mixing and transport apparatus for use with a motor vehicle having a hitch comprising: a bucket having a chamber for accommodating materials, means secured to the bucket for accommodating the hitch to mount the bucket on the hitch, a first auger located in said chamber, first means rotatably mounting the first auger on the bucket, a second auger located in said chamber adjacent and generally parallel to the first auger, second means rotatably mounting the second auger on the bucket, drive means connected to the first and second augers to concurrently rotate the first and second augers, motor means connected to the drive means operable to transmit power to the drive means to rotate the first and second augers thereby mixing the materials in the chamber of the bucket, the bucket has a side wall having an opening aligned with an end of the first auger to allow the first auger to move material through said opening to a location adjacent the bucket, door means mounted on the side wall for selectively opening and closing said opening, and means to move the door means between said open and closed positions relative to the opening.

17. The apparatus of claim 16 wherein: the first auger has a first flight and the second auger has a second flight, said first flight having a helical twist opposite the helical twist of the second flight.

18. The apparatus of claim 16 wherein: the first auger has a helical flight and circumferentially spaced holes in the helical flight to allow materials to flow through the helical flight.

19. The apparatus of claim 18 wherein: the holes in the helical flight are in the middle portion of the helical flight.

20. The apparatus of claim 18 wherein: the first auger has a first flight and the second auger has a second flight, said first flight having a helical twist opposite the helical twist of the second flight.

21. The apparatus of claim 16 wherein: the second auger has a radial member located adjacent a bucket portion for moving material away from the bucket portion adjacent the radial member.

22. The apparatus of claim 16 wherein: the second auger has a helical flight, and a plurality of knives mounted on the flight and extended outwardly from the flight to cut said materials.

23. The apparatus of claim 16 wherein: the drive means comprises sprockets mounted on the first and second augers and the motor means and an endless power transmitting member trained about said sprockets whereby the motor means concurrently rotates said first and second augers, and mount means secured to the bucket for supporting the motor means.

24. The apparatus of claim 16 including: pivot means mounting the door means on the side wall, said means to move the door means comprising a fluid operated cylinder connected to the door means operable to move the door means between open and closed positions relative to the opening.

25. The apparatus of claim 24 including: a rib mounted on the side wall adjacent a lower portion of the opening, said door means having a portion engageable with the rib when the door means is in the closed position to retain the door means in the closed position.

26. The apparatus of claim 16 including: a tubular hub mounted on the side wall and extended into the opening, said hub having means to rotatably mount the first auger.

27. The apparatus of claim 26 including: pivot means mounting the door means on the side wall, said means to move the door means comprising a fluid operated cylinder connected to the door means operable to move the door means between said open and closed positions relative to the opening.

28. The apparatus of claim 27 including: a rib mounted on the side wall adjacent a lower portion of the opening, said door means having a portion engageable with the rib when the door means is in the closed position to retain the door means in the closed position.

29. A materials mixing and transport apparatus for use with a motor vehicle having a hitch comprising: a bucket having a side wall and a chamber for accommodating materials, means secured to the bucket for accommodating the hitch to mount the bucket on the hitch, auger means located in the chamber for mixing materials in the chamber, said auger means having an end located adjacent said side wall, first means rotatably mounting the auger means on the bucket, drive means connected to the auger means to rotate the auger means, motor means connected to the drive means operable to transmit power to the drive means to rotate the auger means thereby mixing the materials in the chamber of the bucket, said side wall having an opening aligned with said end of the auger means to allow the auger means to move material through said opening to a location adjacent the bucket, door means mounted on the side wall for selectively opening and closing the opening, and means to move the door means between said open and closed positions relative to the opening.

30. The apparatus of claim 29 including: pivot means mounting the door means on the side wall, said means to move the door means comprising a fluid operated cylinder connected to the door means operable to move the door means between said open and closed positions relative to the opening.

31. The apparatus of claim 30 including: a rib mounted on the side wall adjacent a lower portion of the opening, said door means having a portion engageable with the rib when the door means is in the closed position to retain the door means in the closed position.

32. The apparatus of claim 29 including: mount means secured to the bucket and located within the chamber of the bucket, and means for supporting the motor means on the mount means.

33. The apparatus of claim 29 wherein: the drive means comprises sprockets mounted on the auger means and the motor means and an endless power transmitting member trained about said sprockets whereby the motor means rotates said auger means, and mount means located within the chamber of the bucket supporting the motor means on the bucket.

34. The apparatus of claim 29 including: a tubular hub mounted on the side wall and extended into the opening, said hub having means to rotatably mount the end of the auger means.

35. In combination, a materials mixing and transport apparatus and a motor vehicle having lift arms for raising and lowering the apparatus, a bucket having a back wall and a chamber for accommodating materials, hitch means secured to the back wall of the bucket connected to the lift arms, a first auger located in said chamber, first means rotatably mounting the first auger on the bucket, a second auger located in said chamber adjacent and generally parallel to the first auger, second means rotatably mounting the second auger on the bucket, drive means connected to the first and second augers to concurrently rotate the first and second augers, motor means connected to the drive means operable to transmit power to the drive means to rotate the first and second augers thereby mixing the materials in the chamber of the bucket, said bucket including a side wall having an opening aligned with an end of the first auger to allow the first auger to move material through said opening to a location adjacent the bucket, door means mounted on the side wall for selectively opening and closing said opening, and means to move the door means between open and closed positions relative to the opening.

36. The combination of claim 35 wherein: the first auger has a first flight and the second auger has a second flight, said first flight having a helical twist opposite the helical twist of the second flight.

37. The combination of claim 35 wherein: the second auger has a radial member located adjacent a bucket portion for moving material away from the bucket portion adjacent the radial member.

38. The combination of claim 35 including: pivot means mounting the door means on the side wall, said means to move the door means comprising a fluid operated cylinder connected to the door means operable to move the door means between said open and closed positions relative to the opening.

39. The combination of claim 38 including: a rib mounted on the side wall adjacent a lower portion of the opening, said door means having a portion engageable with the rib when the door means is in the closed position to retain the door means in the closed position.

* * * * *